US007631524B2

(12) United States Patent
Araujo

(10) Patent No.: US 7,631,524 B2
(45) Date of Patent: Dec. 15, 2009

(54) MULTI-SHACKLE LOCK AND METHOD OF USING THE MULTI-SHACKLE LOCK

(76) Inventor: Alberto Araujo, 3350 SW. 139th Ave., Miramar, FL (US) 33027

( * ) Notice: Subject to any disclaimer, the term of this patent is extended or adjusted under 35 U.S.C. 154(b) by 0 days.

(21) Appl. No.: 11/949,812

(22) Filed: Dec. 4, 2007

(65) Prior Publication Data

US 2008/0209957 A1 Sep. 4, 2008

Related U.S. Application Data

(63) Continuation-in-part of application No. 11/712,636, filed on Mar. 1, 2007, now abandoned.

(51) Int. Cl.
*E05B 37/02* (2006.01)

(52) U.S. Cl. ..... 70/25; 70/26; 70/30; 70/51; 70/52; 70/53; 70/68; 70/69

(58) Field of Classification Search ..... 70/21, 70/25, 26, 30, 49, 51, 53, 68, 69, 284, 285, 70/DIG. 63, DIG. 70, 14, 18, 52, 58–62; 150/102; 190/101, 102, 118–121, 903; 248/551–553
See application file for complete search history.

(56) References Cited

U.S. PATENT DOCUMENTS 268,922 A * 12/1882 Michael et al ..... 70/22
539,650 A * 5/1895 Searle ..... 70/16
695,458 A * 3/1902 Hulzer et al ..... 70/15
1,355,387 A * 10/1920 Cohen ..... 70/29
2,496,320 A * 2/1950 Viekers ..... 70/38 C
3,690,130 A * 9/1972 Eutzler ..... 70/18
3,985,183 A * 10/1976 Fernbaugh ..... 211/7
4,055,973 A * 11/1977 Best ..... 70/58
4,069,691 A * 1/1978 Simpson ..... 70/59
4,069,919 A * 1/1978 Fernbaugh ..... 211/4
4,112,716 A * 9/1978 Wippich ..... 70/38 C
4,212,175 A * 7/1980 Zakow ..... 70/58
4,234,220 A * 11/1980 Finch et al. ..... 292/148
4,435,966 A * 3/1984 Craig ..... 70/161
4,460,093 A * 7/1984 Otema ..... 211/4
4,573,584 A * 3/1986 Otema ..... 211/4
4,598,827 A * 7/1986 Keifer ..... 211/4
4,979,382 A * 12/1990 Perry ..... 70/58
5,150,590 A * 9/1992 Ling ..... 70/69
5,154,072 A * 10/1992 Leyden ..... 70/18
5,443,155 A * 8/1995 Robinson ..... 206/223

(Continued)

*Primary Examiner*—Lloyd A Gall
(74) *Attorney, Agent, or Firm*—Laurence A. Greenberg; Werner H. Stemer; Ralph E. Locher

(57) ABSTRACT

A lock for luggage, sports gear or any type of travel enclosure which can be operated by a key, combination or both, which has at least one removable shackle. The lock has one shackle that secures the lock to the luggage or luggage handle while the other shackle secures the luggage closure or zipper. An addition shackle is provided for the purpose of re-closing the luggage after the luggage is inspected by an international airport security agent. If the luggage is inspected, the inspector simply cuts the zipper shackle and re-secures the luggage using the additional or third shackle. A disposable shackle system allows the customer to replace the cut shackle and return the lock to its original condition for reuse.

25 Claims, 13 Drawing Sheets

U.S. PATENT DOCUMENTS 5,590,772 A * 1/1997 Schuhlen et al. ..... 206/315.3
5,746,075 A 5/1998 Yang
5,787,736 A * 8/1998 Ling ..... 70/26
6,325,219 B1 * 12/2001 Schild ..... 211/8
6,408,660 B1 * 6/2002 Lai ..... 70/30
6,464,269 B1 * 10/2002 Wilhelm et al. ..... 292/307 R
6,799,446 B1 * 10/2004 Tsai ..... 70/30
6,877,345 B1 4/2005 Misner et al.
7,131,298 B1 * 11/2006 Haraughty ..... 70/18
7,201,025 B2 * 4/2007 Mahre et al. ..... 70/18
7,251,965 B2 * 8/2007 Yu ..... 70/21
2005/0155396 A1 * 7/2005 Taljaard et al. ..... 70/56
2005/0279820 A1 * 12/2005 Moynihan et al. ..... 235/375

* cited by examiner

MULTI-SHACKLE LOCK AND METHOD OF USING THE MULTI-SHACKLE LOCK

CROSS-REFERENCE TO RELATED APPLICATION

This application is a continuation-in-part of U.S. application Ser. No. 11/712,636 filed Mar. 1, 2007, now abandoned which is hereby incorporated by reference in its entirety herein.

BACKGROUND OF THE INVENTION

1. Field of the Invention

The invention relates, generally, to locks, and more specifically, it relates to a multi-shackle lock for locking luggage that can be subjected to inspection and then be relocked.

2. Description of the Related Art

Combination operated padlocks of the type typically used to secure luggage during travel and transport are well known. U.S. Pat. No. 6,877,345 teaches combination operated luggage padlocks that also may be operated by a key to facilitate inspection of the contents of luggage. Specifically, the combination and key operated luggage padlocks and the like have a resettable indicator to advise the owner of the luggage that a lock on the bag has been opened presumably by a key for inspection. The opened luggage indicator preferably can be reset only by the owner after he/she has opened the lock by entering a respective combination.

When the U.S. Transportation Security Administration (TSA) took over the handling of airport security in accordance with the Homeland Security Act, the intensified effort made by federal employees to inspect locked bags of airline passengers often resulted in the destruction of luggage padlocks when the shackles thereof were severed to permit inspection of the luggage contents. The destruction of luggage padlocks unfortunately leaves inspected bags unlocked, with their contents subject to pilfer and theft during travel and transport.

The need of travelers for post-inspection luggage security while also accommodating the need of government employees to quickly and easily open and inspect selected and suspect bags, lead to the development of override keys for non-destructively opening the luggage.

Combination operated luggage padlocks that have built-in key override features were now introduced. Such padlocks may be purchased by consumers for locking their luggage; and, if their locked bags are inspected by government personnel, the padlocks will be opened for baggage inspection using keys that are made available to government inspectors (but not to the owners of the padlocks), and then will be relocked by the inspectors. Bags inspected and relocked in this manner will have their contents secured by the same combination operated padlocks that were installed on the bags by the owners thereof.

Padlocks that can be operated by combination and by key are not new. Combination padlocks have been used for many years on gym lockers in schools, with coaches and principals having keys that can open these padlocks should lockers need to be inspected, or should a padlock be snapped closed on an incorrect locker by mistake or by prank. It also is known to provide combination padlocks with keys so that their owners may elect whether to open the locks by entry of a combination, or by using a key.

It is not completely new to provide padlocks with some form of indicator. For example, padlocks that are not of the type that can be opened both by combination and by key have been provided with indicators that are intended to prevent accidental resetting of the combinations of the locks, or that are intended to reflect when the padlocks are incompletely or improperly relocked after being opened. However, prior proposals relating to padlocks of the type that can be opened by combination or by key have not taught or suggested the provision of indicators constructed to advise the owners of the locks that the luggage on which the padlocks are installed has been inspected by opening the padlocks with a key.

SUMMARY OF THE INVENTION

It is accordingly an object of the invention to provide a multi-shackle lock and method of using the multi-shackle lock, which overcomes the herein-mentioned disadvantages of the heretofore-known devices and methods of this general type, which allows the lock to be opened and relocked without the need of a special key.

With the foregoing and other objects in view there is provided, in accordance with the invention, a lock. The lock is formed of a housing, a locking mechanism supported by the housing, and three shackles being lockable by the locking mechanism or the housing.

As noted above, after Sep. 11, 2001 the Transportation Security Administration (TSA) took over the handling of airport security and inspection of luggage. In order to inspect the luggage, the baggage locks had to be cut and the luggage was left unsecured as it traveled throughout the transportation system. TSA then requested that customers not lock their luggage in order to allow inspection without damaging the luggage and the locks.

In an attempt to provide the customers a way of securing their bags while still allowing TSA to carry out their inspection, several companies configured locks with both a key lock and a combination lock and many of these locks have an indicator for identifying if the lock was opened for inspection. Special master keys were then given to the TSA for opening all the locks.

However, these prior art locks simply do not provide the security they advertise. It is a false sense of security for the following few and simple reasons. There are thousands of TSA agents throughout our country, all of which have access to the keys that open the locks. It is only a matter of time, if it has not already occurred that these keys will fall into the hands of what we call the luggage bandit. In many cases the locks have the second key operation option but have no measure for letting the customer know that someone has opened the lock. This is equivalent to having a home alarm system and giving a second alarm security code to thousands of people you do not know. The second reason is that 90% of all luggage used today is of the zipper closure type. On this type of luggage you can simply pull the zipper closure with the locked lock to one extreme of the luggage zipper. Using a sharp object as simple as a ball point pen you can open the zipper and pilfer the luggage. Once finished you can simply pull the closed lock and secured zipper closure to the opposite extreme. This re-zips and closes the zipper 99%. To the untrained eye the luggage shows no signs of having been tampered with until you have arrived to your home or vacation destination. In addition the above-mentioned keys are only available to USA agents and are not available on an international level. Therefore, when traveling internationally, the current so called TSA luggage locks will be cut as before and the luggage will be left unsecured throughout the rest of its journey.

In accordance with an added feature of the invention, the housing includes a main housing and a shackle housing releasably holding one of the three shackles for replacing the one shackle. The main housing houses the locking mechanism and the shackle housing supports two of the three shackles. The shackle housing is releasably connected to the main housing for replacing the shackle housing containing the two shackles with a new shackle housing contain two new shackles.

In accordance with another feature of the invention, the three shackles include a luggage securing shackle made from metal, plastic, cabling, wiring or a combination of at least two of metal, cabling and wiring.

Ideally, the housing has a serial number for at least one of identification, tracking, travel insurance and travel assistance service. Alternatively or additionally, a tracking device is supported by the housing and the lock can be tracked world wide.

In a further embodiment of the invention, each of the three shackles may be color coded for identifying the shackle function. The three shackles include a first shackle locked in place by the locking mechanism, a second shackle locked in place by the locking mechanism, and a third shackle locked in place by the locking mechanism or locking to the shackle housing. Preferably, the second shackle is releasable secured to the shackle housing, and the third shackle is permanently fixed to the shackle housing.

In accordance with another feature of the invention, the shackle housing has a locking key for releasably securing the shackle housing to the main housing. The main housing has a housing side wall with a recess formed therein, and the locking key can be inserted through the recess and held in place by the housing side wall. The shackle housing is rotatable about the locking key for replacing the second shackle. The shackle housing has a wall and the locking key has a cutout formed therein next to the wall for fixing around the housing side wall.

In accordance with another feature of the invention, the main housing and the shackle housing define a recess therebetween. The shackle housing has an abutment extending out from the recess, and the third shackle secures to the abutment when inserted in the recess. Uniquely, the third shackle is released from the abutment when the shackle housing is rotated.

With the foregoing and other objects in view there is further provided, in accordance with the invention, a method of operating a luggage lock. The method includes providing a multi-shackle lock having a main housing, a shackle housing, and two or more, ideally three shackles, including a first shackle, a second shackle and a third or additional shackle. The first shackle is secured to an anchor part of a piece of luggage having a zipper. The second shackle is secured to a zipper pull-tab for preventing an opening of the piece of luggage. The third shackle is left unlocked.

In accordance with a further mode of the invention, the second shackle is cut resulting in a cut second shackle. The piece of luggage is opened for inspection and then relocked by securing the third shackle to the zipper pull tab. After this, the cut second shackle is removed and a new second shackle is inserted putting the lock back to a as new condition.

Alternatively, the shackle housing containing the cut second shackle and the third shackle is removed from the main housing and a new shackle housing containing a new second shackle and a new third shackle is reconnected to the main housing.

In order to perform the replacement, the shackle housing is rotated about the main housing for getting access to the cut second shackle. The cut second shackle is removed and the new second shackle is inserted. The shackle housing is rotated back and the shackle housing is secured in place by inserting the new second shackle into the main housing.

An alternate and preferred embodiment of the invention is a multi-shackle lock which is formed of a main housing which houses two or more shackles, a locking mechanism to close and secure the shackles and a method of releasing any of the shackles for the purpose of replacing them in the event they are cut or their integrity has been compromised.

The lock housing may have but is not limited to a button or push pin type of mechanism that is used to release any of the shackles for the purpose of replacing them after they have been cut or their integrity has been compromised. The button or release mechanism can only be operated when the lock is placed in the open position by setting the lock to a preset combination, by opening the lock with a key or any combination thereof.

It is the intent of the invention that only the customer is able to open the lock with a combination or key and that only after the lock has been opened can the broken shackles be released by a button or mechanism which allows the owner of the lock to replace the shackle or shackles.

With the foregoing and other objects in view there is further provided, in accordance with the invention, a second embodiment of the lock. This lock contains a housing, a locking mechanism supported by the housing, and a first shackle releasably locked by the locking mechanism to allow the first shackle to be replaced. A button is provided and is supported by the housing for locking or releasing one end of the first shackle.

In accordance with an added feature of the invention, a second shackle is releasably locked by the locking mechanism to allow the second shackle to be replaced. In addition, a third shackle is releasably locked by the locking mechanism to allow the third shackle to be replaced, the third shackle is disposed on an end opposite the first and second shackles.

In accordance with another feature of the invention, the button releases or locks one end of the first and second shackles.

In accordance with a further feature of the invention, a seat is provided for supporting the locking mechanism, and a locking plate is pivotably mounted in the seat pivotable between a first position and a second position in dependence on the locking mechanism. If the locking plate is in the first position, the shackle is locked in place, and if the locking plate is in the second position, the shackle is removable from the lock.

The button has a locking trigger engaging the shackle in a locked position when the locking plate is in the first position. The button is actuable when the locking plate is in the second position. Upon actuation of the button, the locking trigger expels one end of the shackle from the housing.

In accordance with another added feature of the invention, a shaft supports the locking mechanism. A lever is provided that has a recess for receiving and locking in place a second end of the shackle. When the locking plate is in the first position, the locking plate prevents movement of the lever. When the locking plate is in the second position, the lever is movable for releasing the shackle from the housing.

In accordance with a concomitant feature of the second embodiment of the invention, a locking gate is provided for securing both ends of the third shackle. When the locking plate is in the second position, the locking gate is moveable against the shaft, pushing in the shaft, and releasing both ends of the third shackle for removing the third shackle from the lock.

Other characteristic features of the invention are set forth in the appended claims.

Although the invention is illustrated and described herein as embodied in a multi-shackle lock and a method of using the multi-shackle lock, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of specific embodiments when read in connection with the accompanying drawings.

DESCRIPTION OF THE PREFERRED EMBODIMENTS

Figure 1:
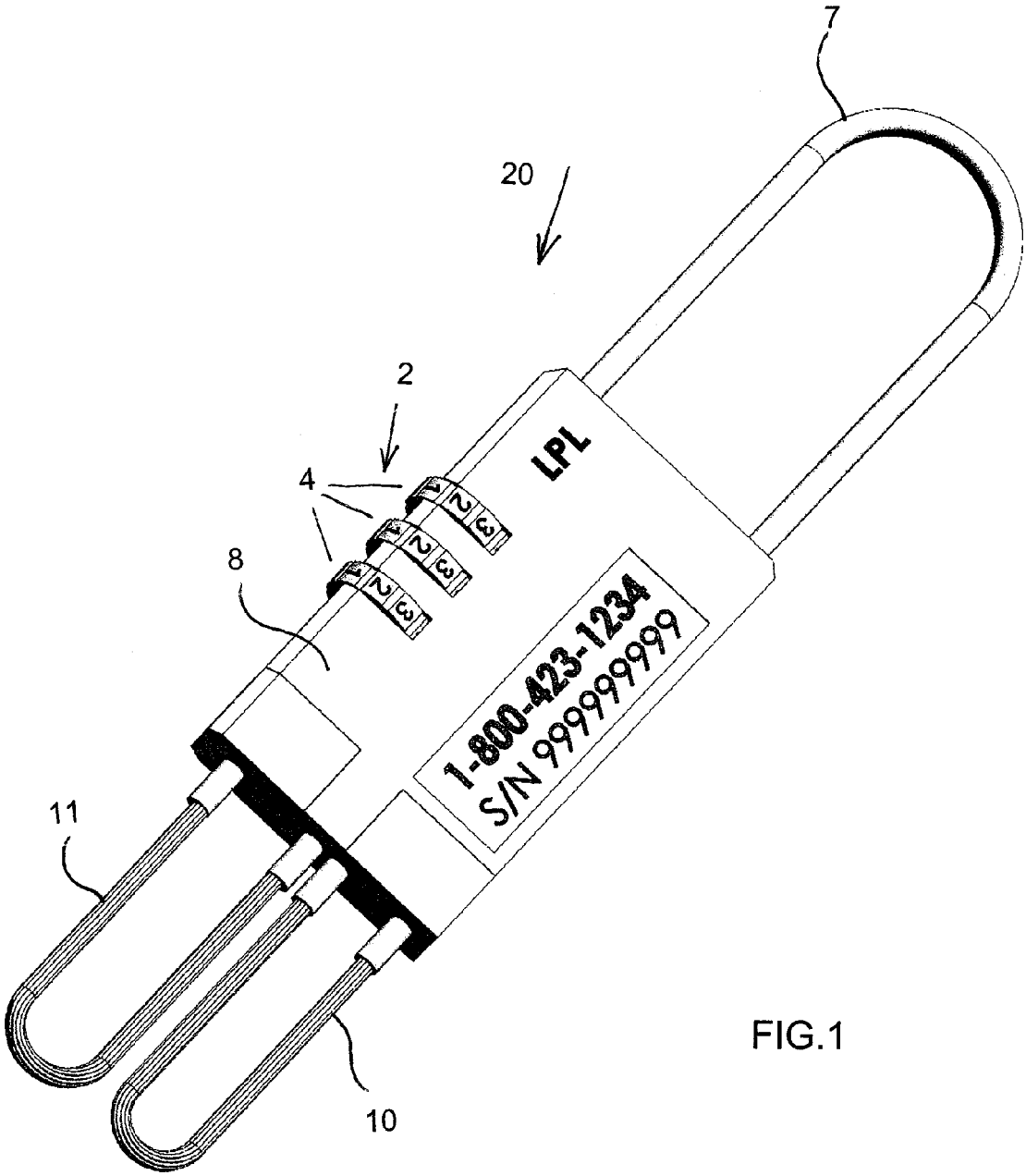
FIG. 1 is a diagrammatic, perspective view of a first embodiment of the multi-shackle lock according to the invention.

Referring now to the figures of the drawing in detail and first, particularly, to FIG. 1 thereof, there is shown a first embodiment of a lock 20 being a combination operated lock, a key operated lock or both a combination and key operated lock 20 all with a multi-shackle locking system.

The multi-shackle lock 20 can be operated by a preset combination, a key, or both the preset combination and the key. The operation of the lock 20 is similar to locks currently on the market for use on luggage, sport bags or equipment cases. In FIG. 1, the lock 20 is provided with a single combination lock mechanism 2 having three combination thumb wheels 4 for operating the combination lock mechanism 2. Of course the number of thumb wheels 4 can vary between 2-6. A single key lock or two locks being a key and combination lock are also possible, however FIG. 1 only shows a single combination lock 2 without the need for a key.

Figure 2:
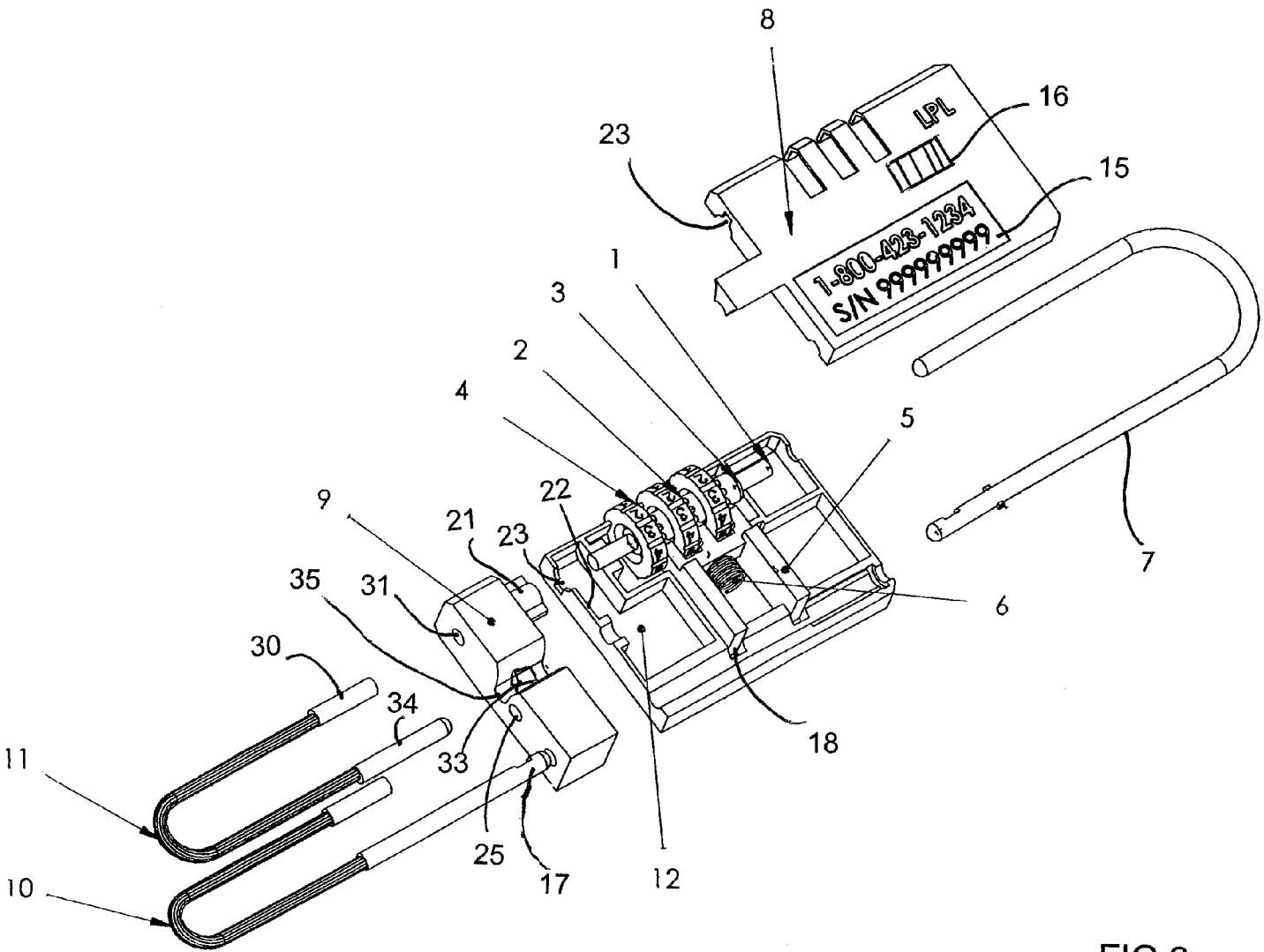
FIG. 2 is a diagrammatic, exploded perspective view of the first embodiment of the multi-shackle lock.

As best shown in FIG. 2, the multi-shackle lock 20 has a housing formed of two connectable housing parts 8, 12 and a removable shackle housing 9.

The lock 20 features a unique multi-shackle system that allows the lock 20 to be secured to a piece of luggage, more particularly to a luggage handle. What is further specific and unique about the lock 20 is that it can only be operated by the owner of the lock 20 because only the single combination lock mechanism 2 is present. However, the lock 20 still allows TSA and all international security agents to inspect the luggage and return it to a locked condition by providing additional unlocked shackles. A first shackle 7 is used to secure the lock 20 to a luggage handle or similar anchor part on a piece of luggage. The use of the luggage handle eliminates the possibility of moving the lock 20 to the zipper extreme, opening the luggage and using the closed lock to reseal the zipper. A second shackle 10 is used by the owner to close or secure the luggage opening, e.g. lock the zipper tab (slider) to the luggage handle. A third shackle 11 is left in the open position so that security agents can cut open the lock (e.g. the second shackle 10) as they have done for many years and re-close the lock 20 using the third shackle 11 after the luggage has been inspected.

Figure 3:
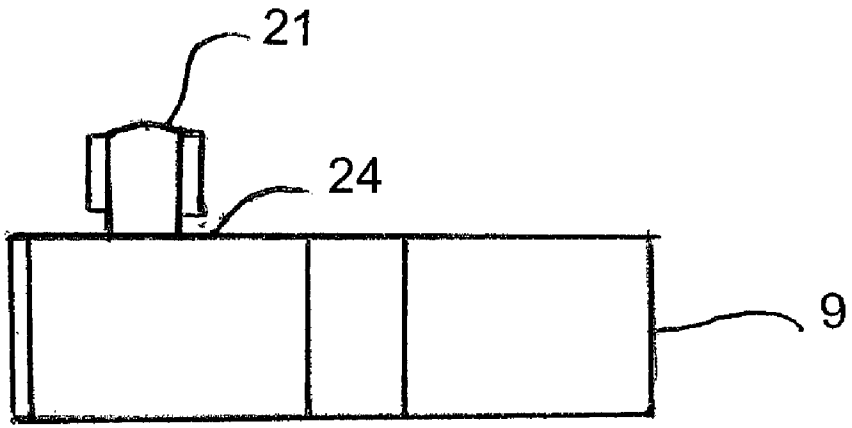
FIG. 3 is a diagrammatic, top plan view of a shackle housing the first embodiment.

The multi-shackle lock 20 further has the capability of replacing the shackle housing 9. The shackle housing 9 with the second and third shackles 10, 11 is supplied as a disposable part. Once the second shackle 10 has been cut by TSA, the owner can open the lock 20, replace the shackle housing 9 containing new second and third shackles 10, 11 and return the lock 20 to an as new condition. The shackle housing 9 has a locking key 21 for engaging on an inside wall 22 of the upper and lower housings 8, 12. The locking key 21 is initially positioned at a 90 degrees angle so that the locking key 21 slides through a recess 23. As the shackle housing 9 is rotated from the 90 degrees angle back to the normal, the locking key 21 engages the inside wall 22 and secures the shackle housing 9. As best seen in FIG. 3, there is a space 24 between the locking key 21 and a wall of the shackle housing 9 for allowing the connection between the shackle housing 9 and the upper and lower housing parts 8, 12.

Figure 4:
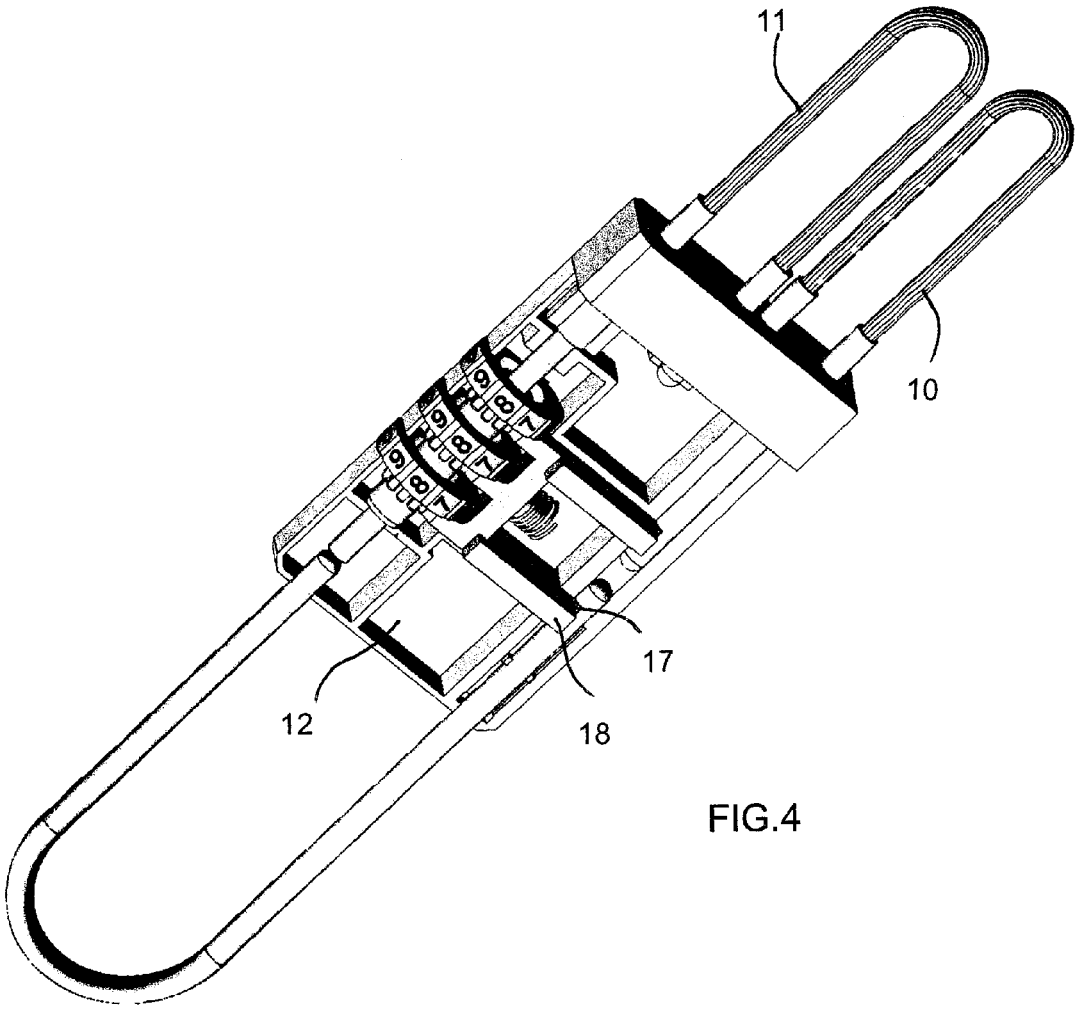
FIG. 4 is a perspective view of the first embodiment of the multi-shackle lock with a top cover removed.
Figure 5:
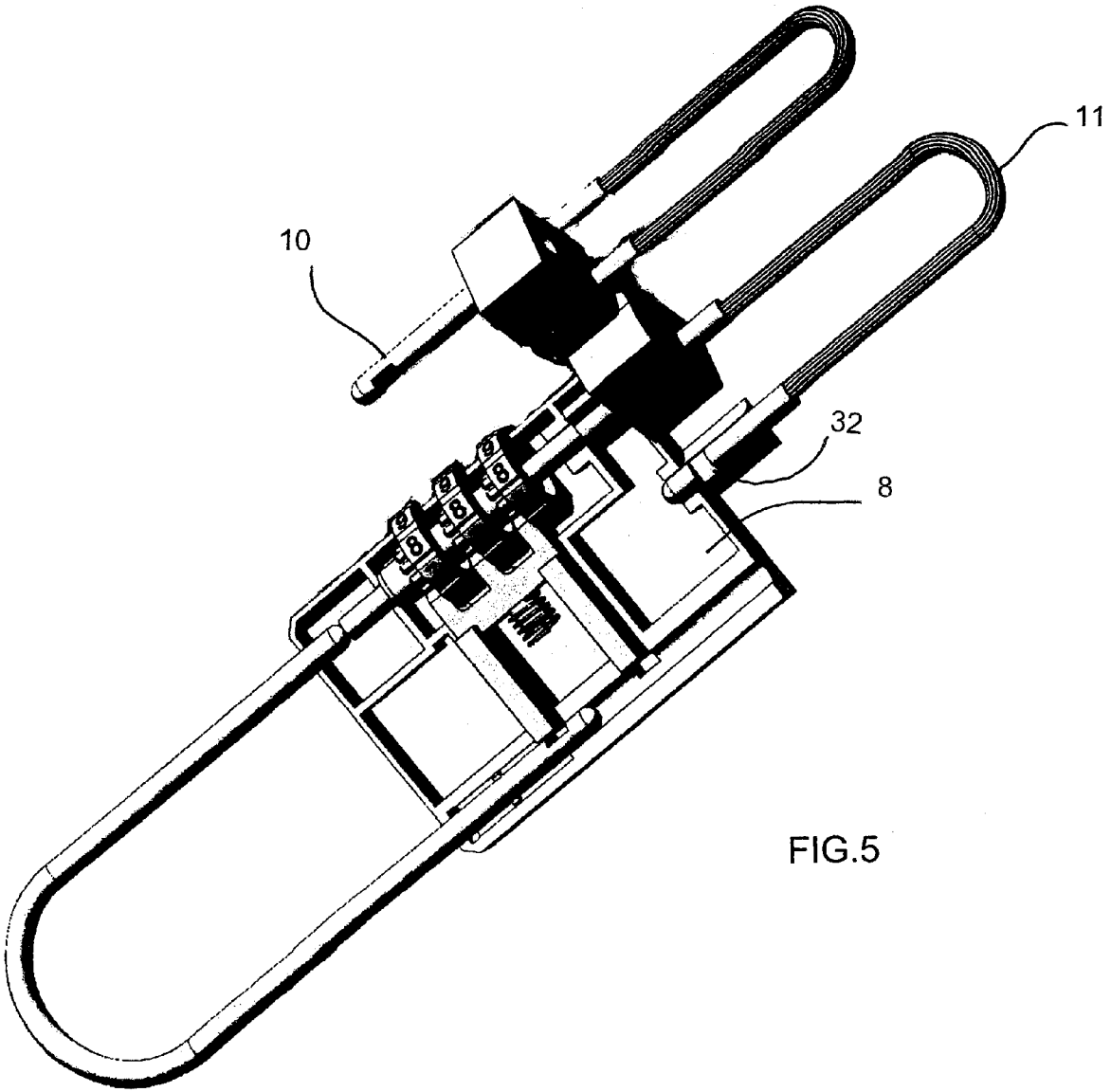
FIG. 5 is a perspective view of the first embodiment of the multi-shackle lock with a shackle housing in a rotated position and a bottom cover removed.

The second shackle 10 has a notch 17 for engaging into a locking projection 18 of the combination lock mechanism 2. When the locking projection 18 engages in the notch 17 of the second shackle 10, the second shackle 10 secures the shackle housing 9 to the lock housing 8, 12, see FIG. 4. When the second shackle 10 is cut, the second shackle 10 can be removed. After the second shackle is removed, the shackle housing 9 can be rotated and physically pulled out from the housing 8, 12 because the locking key 21 can now slip out of the recess 23. In this way the whole shackle housing 9 can be rotated, removed and then replaced as described above. FIG. 5 shows the shackle housing 9 in a rotated position for removal or insertion.

Alternatively, the shackle housing 9 need only be partially rotated in which access to a first hole 25 is provided. As noted, the shackle housing 9 is partially rotated, the cut second shackle 10 is removed and a replacement shackle 10 is threaded through the first hole 25 and the shackle housing 9 is closed again.

At this point it needs to be emphasized that when replacing either the shackle housing 9 or the second shackle 10, the housing parts 8, 12 remain secured to each other at all times and are not separated from each other as shown in the figures.

Figure 6:
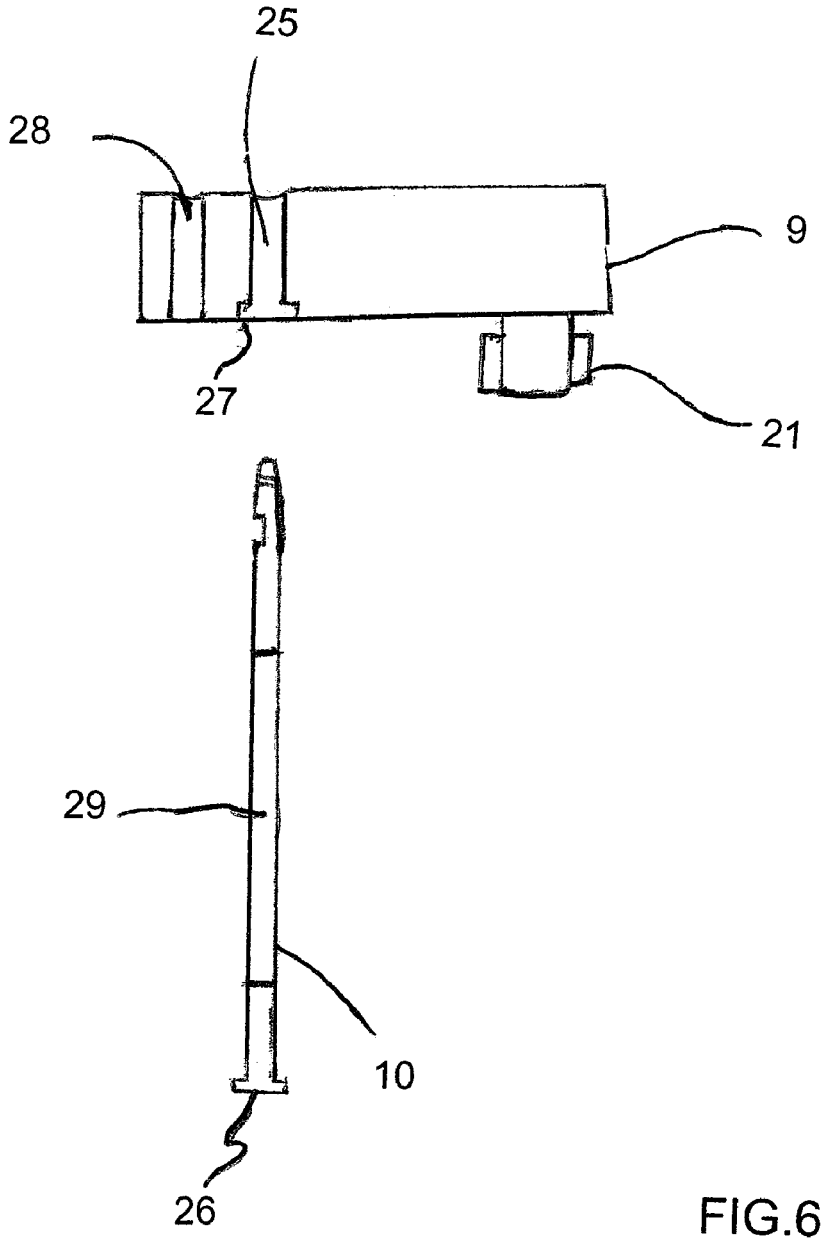
FIG. 6 is a diagrammatic, longitudinal view of the shackle housing showing only the openings for a second shackle of the first embodiment.
Figure 7:
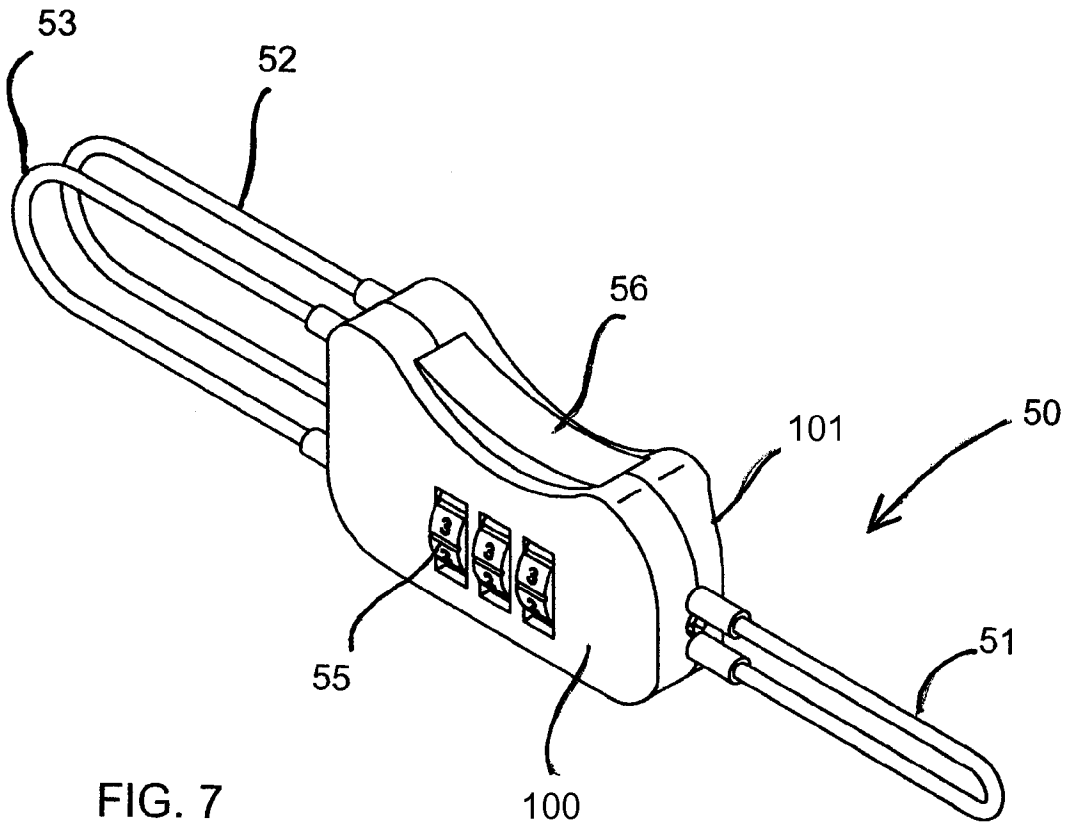
FIG. 7 is a diagrammatic, perspective view of a second embodiment of the multi-shackle lock according to the invention.

FIG. 6 shows a top, sectional view of the shackle housing 9 showing only the openings for the second shackle 10. The second shackle 10 has a winged end 26 for fitting in a recess 27 at the end of the first hole 25 and therefore securing the second shackle 10 to the shackle housing 9. The second shackle 10 has a mid-section 29 formed from wiring or cabling and is bent around and reinserted into a second hole 28. In this manner, a supply of second shackles 10 is sold with the lock for multiple reuses.

Returning to FIG. 2, a first end 30 of the third shackle 11 is fixedly secured in a third hole 31 of the shackle housing 9. A second end 34 of the third shackle 11 has a notch 32 (see FIG. 5) for locking with an abutment 33 (see FIG. 2) when the second end 34 is inserted into recess 35 formed between the top cover 8 and the shackle housing 9. Of course the locking mechanism can be reversed with an abutment formed on the second end 34 of the third shackle 11 for latching with a cutout formed in the recess 35. As can best be seen in FIG. 5, when the shackle housing 9 is rotated, the second end 34 of the third shackle 11 is automatically released and ready for reuse.

The multi-shackle lock 20 addresses all the fore mentioned issues relating to the prior art locks alone or the locks with a special TSA key. By securing the lock 20 to the luggage or luggage handle you eliminate the possibility of having the lock being used to reseal the zipper. With this method the zipper can't be resealed and therefore will most likely never be opened. By providing the additional shackles 10, 11 the customer can lock his\her luggage and use it both nationally and internationally. The customer simply locks the luggage, the international agent simply cuts it open for inspection and re-locks it with the additional shackle.

Ideally, the locks will all be the same colors, such as a bright orange with separate colors to identify the different shackle of the system. Therefore the lock of the instant application requires no intervention or cooperation with TSA or other agencies (e.g. send them master keys).

In addition the multi-shackle lock 20 may be provided with additional security features such as a serial number 15 or tracking bar code and/or tracking device 16. The tracking device 16 may be an active or passive radio frequency identifier (RFID), a global positioning satellite (GPS) reader or other electronic/visual tracking device.

In this manner, a luggage tracking service and a travel assistance service can be easily incorporated or used with the lock. Ideally, the information relating to the location of the lock 20 can be provided on a web site under each specific customer account. The customer logs on to our web site using his or her user name and password. The site shows a page that displays all the locks owned by that specific customer and where they are. In addition, the website allows reorders for new shackles.

As noted above, the multi-shackle lock can be used universally (e.g. internationally) where any airport inspection agency can use the lock and at the same time, the owner will know that his luggage has been inspected.

FIGS. 7-12 show a second embodiment of a multi-shackle lock 50 also having three shackles 51-53. It is noted here that the second embodiment can function with 1, 2 or 3 shackles as the shackles are all independently and readily replaceable. In other words, a replaceable single shackle lock or a two-shackle lock is possible in addition to the three-shackle lock that is shown. As in the first embodiment, the second embodiment has a locking mechanism 55 for securing the shackles. However, the second embodiment has a release button 56 that is used in combination with the lock 55 for securing and releasing the shackles 52-53.

A front housing part 100 and a back housing part 101 house the lock 55 and the release button 56. As shown best in FIG. 8, the locking mechanism 55 is mounted in a seat 57 via a shaft 58 and respective openings 59 and 60 in the seat 57 for receiving the shaft 58. The seat 57 has a locking plate 61 which is spring biased to an upward position by non-illustrated springs disposed below the locking plate 61 towards the rear of the seat 57. When the combination of the locking mechanism 55 is correct, the locking plate 61 pivots up as shown by arrow 62. When the combination of the locking mechanism 55 is incorrect the locking plate 61 is kept pushed down, see arrow 62. When the locking plate 61 is pushed down, it blocks the movement of the release button 56 and therefore the shackles 52-53 cannot be removed. The operation of such a locking mechanism 55 for moving a locking plate is known from U.S. Pat. No. 5,746,075 which is hereby incorporated by reference herein.

Figure 8:
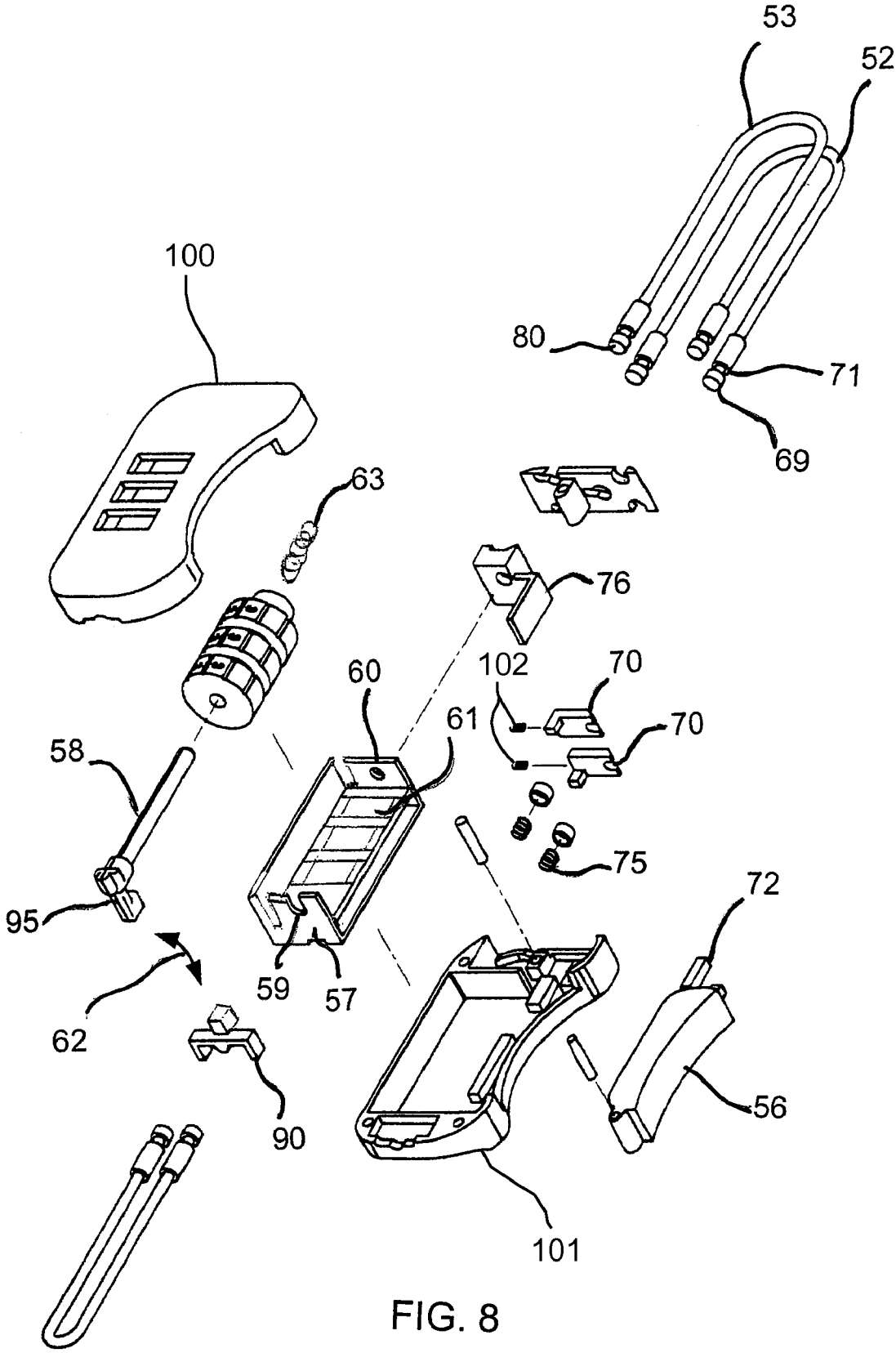
FIG. 8 is an exploded, perspective view of the second embodiment of the multi-shackle lock.
Figure 9:
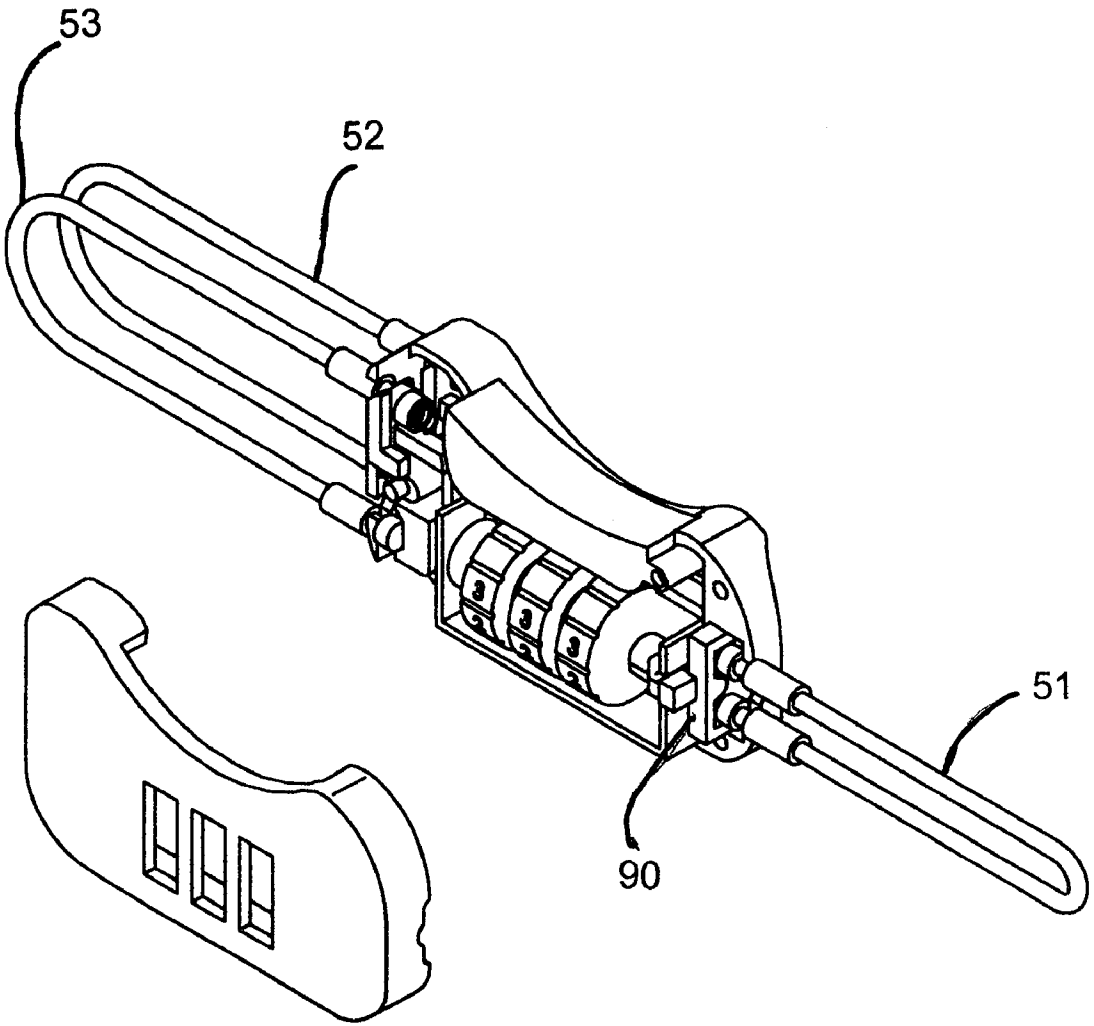
FIG. 9 is perspective view of the second embodiment of the multi-shackle lock with the cover removed.
Figure 10:
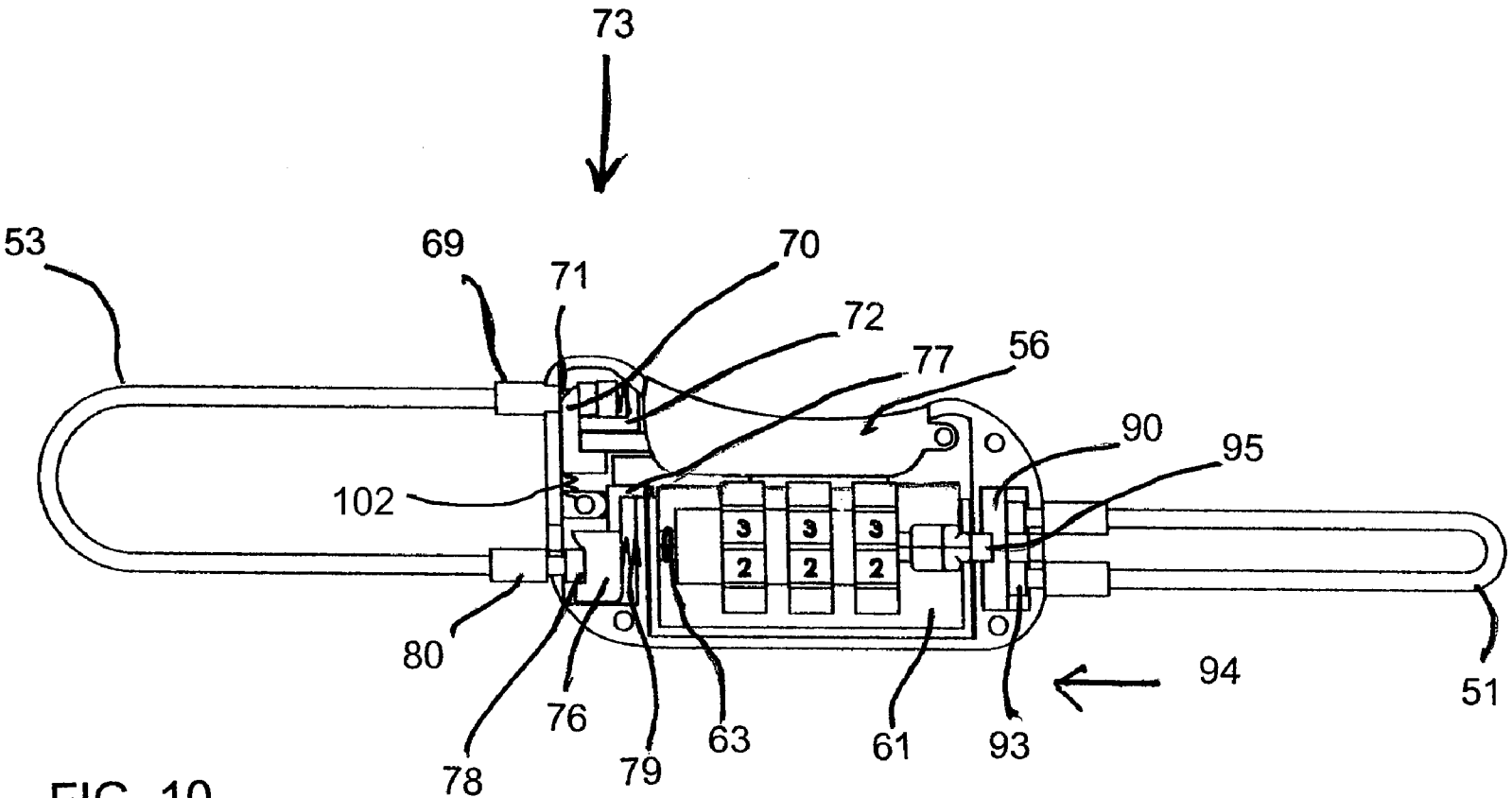
FIG. 10 is a side elevational view of the second embodiment of the multi-shackle lock with the cover removed.

As shown in FIG. 8, two locking triggers 70 hold first ends 69 of the shackles 52, 53 in place. As seen in FIG. 10, the shackles 52, 53 have grooves 71 engaged by the locking triggers 70 holding the shackles 52, 53 in a locked position. The release button 56 has a first arm 72. When the combination of the locking mechanism 55 is correct, the release button 56 can be pushed in or actuated because the locking plate 61 no longer obstructs movement of the release button 56. When the release button 56 is pushed in, the first arm 72 travels in a direction of arrow 73 (FIG. 10) and pushes the locking triggers 70 out of engagement of the grooves 71 of the shackles 52, 53 and the shackles 52, 53 are thereby no longer locked in place. The ends 69 of the shackles 52, 53 pop out of the lock 50 because the triggers 70 are spring biased by springs 102, allowing springs 75 to push the shackles out when the triggers 70 are moved out of their locking position.

Second ends 80 of the shackles 52, 53 are held in place by lever 76. When the combination of the locking mechanism 55 is correct, the locking plate 61 moves up and out of the way of locking arm 77 of the lever 76. In this manner, the lever 76 can be pushed in and the second ends 80 of the shackles 52, 53 can be removed from the lock 50. The lever 76 is spring biased by a spring 79 to push the lever 76 into the shackles 52, 53 for securing the shackles 52, 53 in place.

Figure 11:
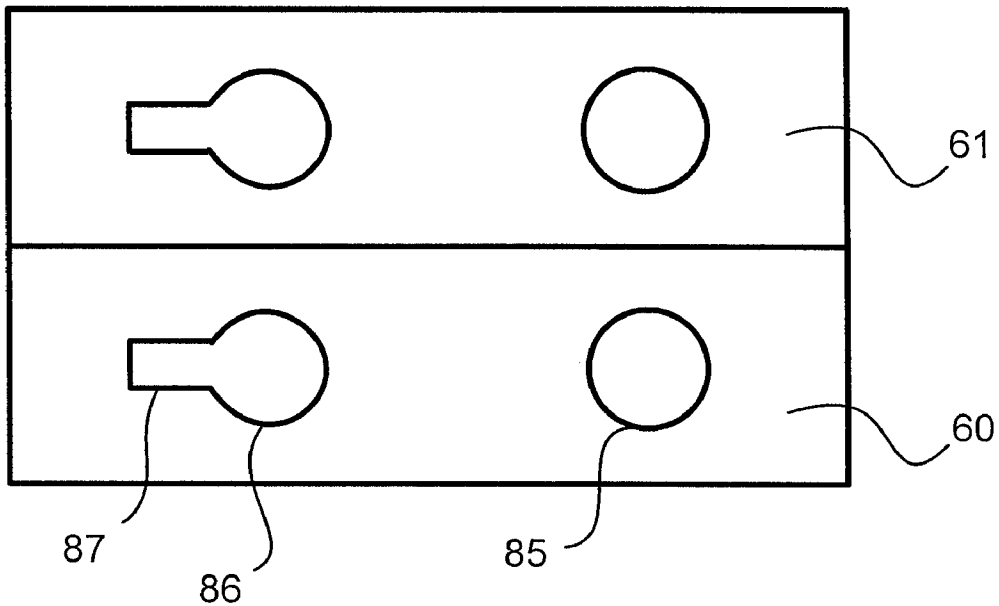
FIG. 11 is a diagrammatic, left-side plan view of the second embodiment of the multi-shackle lock with the shackles removed.

FIG. 11 shows a side view of the housing 100, 101 with recesses 85 and 86. The first ends 69 of the shackles 52, 53 are pressed into the recesses 85. The second ends of the shackles 80 are pressed in the recess 86 and slide into the associated slots 87 for securement into a recess 78 (FIG. 10) formed in the lever 76. The recess 78 is defined by a shoulder preventing the movement of the shackle 53 out of the lever 76 unless the lever 76 is first pushed in.

Figure 12:
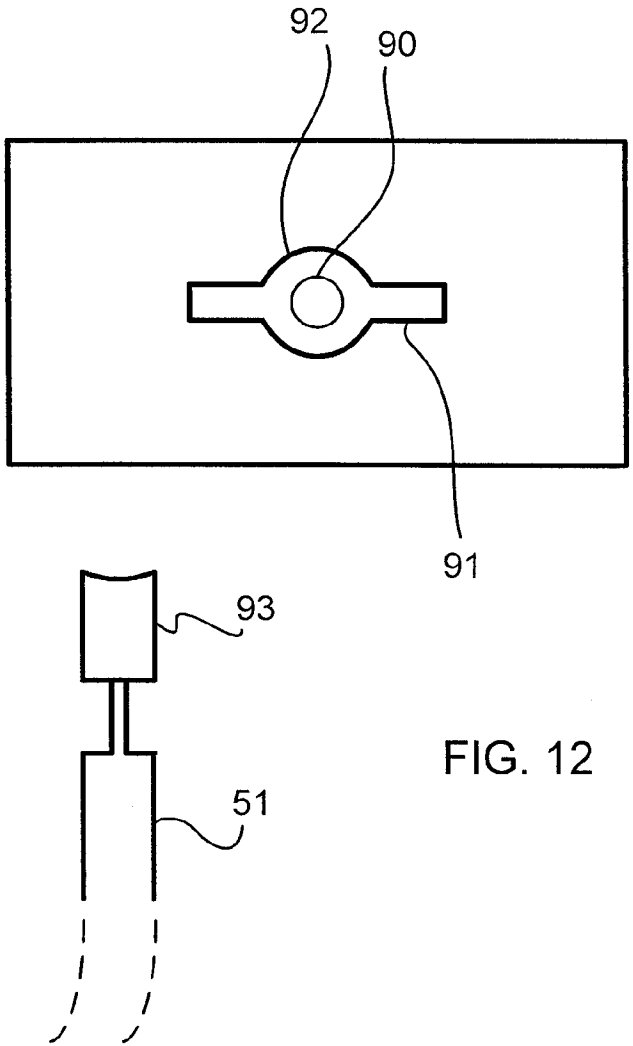
FIG. 12 is a diagrammatic, right-side plan view of the second embodiment of the multi-shackle lock with the shackles removed.

The shackle 51 is also releasably held in the housing 100, 101 in a similar fashion. Both ends of the shackle 51 are held in a locking gate 90. More specifically, as shown in FIGS. 12 and 10, ends 93 of the shackle 51 are entered into a central recess 92, one at a time and slide along the slides 91 into a locked position to the sides of the central recess 92 and held by the locking gate 90. When the combination of the locking mechanism 55 is not proper the shaft 58 is locked in place blocking any movement of the locking gate 90. When the combination of the locking mechanism 55 is proper, the shaft 58 can be pushed in the direction of arrow 94 shown in FIG. 10 and the ends 93 of the shackle can be moved from the slot 91 to the recess 92 and removed. The shaft 58 is spring biased by spring 63 towards the locking gate 90. When the combination is correct, the user pushes in the shackle 51, which in turn pushes in the gate 90. More specifically, the gate 90 directly abuts to protrusion 95 that pushes against the shaft 58 counter to the spring 63. The shaft 58 and the locking gate 90 move in the direction of the arrow 94 allowing the shackle 51 to be pulled out via the slide and recess 91, 92. The shaft 58 has the protrusion 95 that is disposed in a recess formed in the locking plate 61. When the locking plate 61 is in the raised position, the shaft 58 can be moved when pushed by the locking gate 90. In the lowered position, the locking plate 61 blocks the movement of the protrusion 95 and thus the movement of the shaft 58 and therefore locks the shackle 51 in place. The protrusion 95 has a narrow area and a thickened area. The thickened area hits the locking plate 61 when the locking plate 61 is in the lowered position. The narrow area allows movement towards the locking plate 61 when the locking plate 61 is in the raised position.

Figure 13:
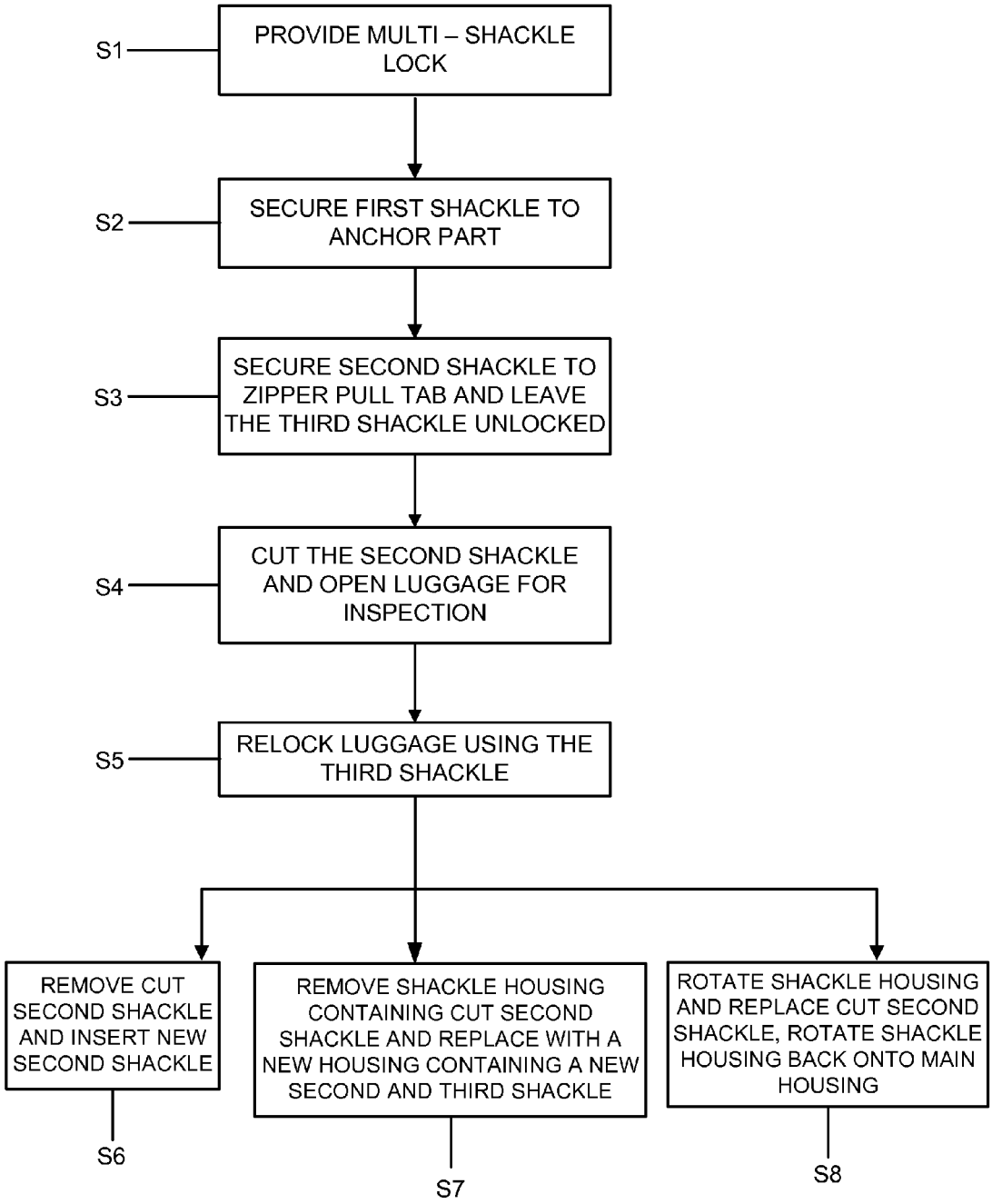
FIG. 13 is a flowchart for illustrating a luggage securing method.

FIG. 13 is a flow chart describing the use of the multi-shackle lock. In step S1, a multi-shackle lock having three shackles is provided. The first shackle is secured to an anchor part of a piece of luggage, step S2. The second shackle is secured to a zipper and the third shackle is left unlocked, step S3. In order for the luggage to be inspected, the second shackle is cut, and than the luggage is opened and inspected, step S4. Then the luggage is relocked with the third shackle, step S5. Then the cut second shackle is removed and a new second shackle is inserted, step S6. Alternatively, the shackle housing containing the cut second shackle is removed and a new housing containing a new second and third shackle is installed, step S7. Instead of removing the shackle housing, it can be rotated, for allowing access for removing the second cut shackle. A new second shackle is then inserted and the shackle housing is rotated back to a locked position, step S8.

I claim:

1. A lock, comprising:

a housing;

a locking mechanism supported by said housing; and three separate shackles being lockable by one of said locking mechanism and said housing, said locking mechanism unlocking at least two of said three shackles upon a single actuation of said locking mechanism;

said housing having a main housing and a shackle housing, said shackle housing releasably holding one of said three shackles for replacing said one shackle;

said shackle housing having a locking key for releasably securing said shackle housing to said main housing;

said main housing having a housing side wall with a recess formed therein, said locking key being inserted through said recess and being held in place by said housing side wall;

said shackle housing is rotatable about said locking key for replacing said second shackle.

2. The lock according to claim 1, wherein:

said main housing houses said locking mechanism; and said shackle housing supporting two of said three shackles, said shackle housing releasably connected to said main housing for replacing said shackle housing containing said two shackles.

3. The lock according to claim 1, wherein said three shackles include a luggage securing shackle made from a material selected from the group consisting of metals, plastics, cables, wiring and a combination of at least two of metal, cabling and wiring.

4. The lock according to claim 1, wherein said housing has a serial number for at least one of identification, tracking, travel insurance and travel assistance service.

5. The lock according to claim 1, further comprising a tracking device supported by said housing.

6. The lock according to claim 1, wherein said locking mechanism is a combination operated locking mechanism.

7. The lock according to claim 1, wherein each of said three shackles is color coded for identifying said shackle function.

8. The lock according to claim 1, wherein said three shackles include:

a first shackle being locked in place by said locking mechanism;

a second shackle being locked in place by said locking mechanism; and a third shackle locking to said shackle housing.

9. The lock according to claim 8, wherein:

said second shackle is releasably secured to said shackle housing; and said third shackle is permanently fixed to said shackle housing.

10. The lock according to claim 1, wherein:

said main housing and said shackle housing define a recess therebetween;

said shackle housing having an abutment extending out from said recess;

said third shackle securing to said abutment when inserted in said recess.

11. The lock according to claim 10, wherein said third shackle is released from said abutment when said shackle housing is rotated.

12. The lock according to claim 1, wherein said shackle housing has a wall and said locking key has a cutout formed therein next to said wall for fixing around said housing side wall.

13. A method of operating a luggage lock, which comprises the steps of:

providing a multi-shackle lock having a main housing and three shackles, including a first shackle, a second shackle and a third shackle;

securing the first shackle to an anchor part of a piece of luggage having a zipper;

securing the second shackle to a zipper pull tab for preventing an opening of the piece of luggage; and leaving the third shackle unlocked.

14. The method according to claim 13, which further comprises:

cutting the second shackle resulting in a cut second shackle;

opening the piece of luggage;

relocking the piece of luggage by securing the third shackle to the zipper pull tab.

15. The method according to claim 14, which further comprises:

removing the cut second shackle; and inserting a new second shackle.

16. The method according to claim 14, which further comprises:

removing a shackle housing containing the cut second shackle and the third shackle from the main housing;

connecting a new shackle housing containing a new second shackle and a new third shackle to the main housing.

17. The method according to claim 14, which further comprises:

rotating a shackle housing about the main housing for getting access to the cut second shackle;

removing the cut second shackle;

inserting a new second shackle into the shackle housing;

rotating back the shackle housing; and securing the shackle housing in place by inserting the new second shackle into the main housing, thereby the new second shackle locks the shackle housing to the main housing and prevents rotation of the shackle housing.

18. A lock, comprising:

a housing;

a locking mechanism supported by said housing and having a single lock;

a first shackle releasably locked by said locking mechanism to allow said first shackle to be replaced;

a second shackle releasably locked by said locking mechanism to allow said second shackle to be replaced;

a third shackle releasably locked by said locking mechanism to allow said third shackle to be replaced, said third shackle disposed on an end opposite said first and second shackles, said first, second and third shackles being separate and independent shackles;

a seat for supporting said locking mechanism; and a locking plate pivotably mounted in said seat pivotable between a first position and a second position in dependence on said locking mechanism:

if said locking plate is in said first position, said first shackle is locked in place; and if said locking plate is in said second position, said first shackle is removable from the lock.

19. The lock according to claim 18, further comprising a button supported by said housing for actuating a locking or releasing of one end of said first shackle.

20. The lock according to claim 19, wherein said button actuates a releasing or locking of one end of said first and second shackles.

21. The lock according to claim 19, wherein said button has a locking trigger engaging said first shackle in a locked position when said locking plate is in said first position, said button being actuable when said locking plate is in said second position, upon actuation of said button, said locking trigger expelling said one end of said first shackle from said housing.

22. The lock according to claim 18, further comprising:

a shaft supporting said locking mechanism; and a lever having a recess formed therein for receiving and locking in place a second end of said first shackle, when said locking plate is in said first position, said locking plate preventing a movement of said lever, when said locking plate is in said second position, said lever being movable for releasing said first shackle from said housing.

23. A lock, comprising:

a housing;

a locking mechanism supported by said housing and having a single lock;

a first shackle having first and second ends releasably locked by said locking mechanism to allow said first shackle to be replaced;

a second shackle having first and second ends releasably locked by said locking mechanism to allow said second shackle to be replaced;

a third shackle having first and second ends releasably locked by said locking mechanism to allow said third shackle to be replaced, said third shackle disposed on an end opposite said first and second shackles, said first, second and third shackles being separate and independent shackles;

a button supported by said housing for actuating a locking or releasing of one end of said first shackle;

a seat;

a shaft disposed in said seat and supporting said locking mechanism; and a locking plate pivotably mounted in said seat pivotable between a first position and a second position in dependence on said locking mechanism:

if said locking plate is in said first position, said three shackles are locked in place; and if said locking plate is in said second position, said three shackles are removable.

24. The lock according to claim 23, further comprising a locking gate securing both ends of said third shackle.

25. The lock according to claim 24, wherein when said locking plate is in said second position, said locking gate is moveable against said shaft, pushing in said shaft, and releasing both ends of said third shackle for removing said third shackle from the lock.

* * * * *